US010570686B2

(12) United States Patent
Meador et al.

(10) Patent No.: US 10,570,686 B2
(45) Date of Patent: Feb. 25, 2020

(54) TOP SET LINER HANGER AND PACKER WITH HANGER SLIPS ABOVE THE PACKER SEAL

(71) Applicants: Charles M. Meador, Cypress, TX (US); Matthew J. Krueger, Houston, TX (US); Mark E. Ramey, Houston, TX (US)

(72) Inventors: Charles M. Meador, Cypress, TX (US); Matthew J. Krueger, Houston, TX (US); Mark E. Ramey, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/908,164

(22) Filed: Feb. 28, 2018

(65) Prior Publication Data

US 2018/0187499 A1 Jul. 5, 2018

Related U.S. Application Data

(63) Continuation of application No. 15/259,246, filed on Sep. 8, 2016, now Pat. No. 10,233,709.

(51) Int. Cl.

| | |
|---|---|
| ***E21B 23/01*** | (2006.01) |
| ***E21B 33/128*** | (2006.01) |
| ***E21B 33/129*** | (2006.01) |

(52) U.S. Cl.

CPC ..... *E21B 23/01* (2013.01); *E21B 33/128* (2013.01); *E21B 33/129* (2013.01)

(58) Field of Classification Search

CPC ..... E21B 29/01; E21B 29/06; E21B 33/128; E21B 33/129; E21B 23/01; E21B 23/06

See application file for complete search history.

(56) References Cited

U.S. PATENT DOCUMENTS

| | | | | |
|---|---|---|---|---|
| 3,195,646 | A * | 7/1965 | Brown | E21B 23/01 166/208 |
| 4,307,781 | A | 12/1981 | Preston et al. | |
| 4,662,453 | A | 5/1987 | Brisco | |
| 4,753,444 | A | 6/1988 | Jackson et al. | |
| 6,431,277 | B1 | 8/2002 | Cox et al. | |
| 6,467,540 | B1 | 10/2002 | Weinig et al. | |
| 7,383,891 | B2 | 6/2008 | Fay et al. | |
| 7,546,872 | B2 | 6/2009 | McGilvray, Jr. et al. | |
| 8,322,450 | B2 | 12/2012 | Meijer | |

(Continued)

OTHER PUBLICATIONS

International Search Report and Written Opinion for International Application No. PCT/US2017/045271; International Filing Date Aug. 3, 2017; dated Nov. 15, 2017 (pp. 1-12).

*Primary Examiner* — Kenneth L Thompson

(74) *Attorney, Agent, or Firm* — Cantor Colburn LLP

(57) ABSTRACT

A downhole tool including a mandrel, at least one moveable component mounted to the mandrel, and a locking ring mounted to the mandrel. The locking ring includes a plurality of locking ring segments that enable relative movement between the mandrel and the at least one moveable component. A plurality of circumferential spaces is arranged between corresponding ones of the locking ring segments. At least one load bar is arranged in at least one of the plurality of circumferential spaces. The at least one load bar is mechanically connected to the at least one moveable component.

11 Claims, 9 Drawing Sheets

(56) References Cited

U.S. PATENT DOCUMENTS

| | | | | |
|---|---|---|---|---|
| 10,233,709 | B2 * | 3/2019 | Meador | E21B 33/129 |
| 2004/0036225 | A1 | 2/2004 | Ritter et al. | |
| 2009/0038808 | A1 * | 2/2009 | Anderson | E21B 23/01 166/382 |
| 2009/0294137 | A1 | 12/2009 | Meijer | |
| 2014/0238689 | A1 | 8/2014 | Hughes et al. | |
| 2015/0034299 | A1 | 2/2015 | Burckhard | |
| 2015/0315849 | A1 | 11/2015 | Stautzenberger et al. | |
| 2016/0010421 | A1 | 1/2016 | Henderson et al. | |
| 2018/0087347 | A1 | 3/2018 | Rochen | |

* cited by examiner

TOP SET LINER HANGER AND PACKER WITH HANGER SLIPS ABOVE THE PACKER SEAL

CROSS REFERENCE TO RELATED APPLICATIONS

This application is a continuation of an earlier filing date from U.S. application Ser. No. 15/259,246 filed Sep. 8, 2016, the entire disclosure of which is incorporated herein by reference.

BACKGROUND

Resource exploration systems employ a system of tubulars that extend from a surface downhole into a formation. The tubulars often include components having adjustable portions such as hangers, packers, screens and the like that may be remotely activated. Often times, remote activation includes introducing tools from the surface into the system of tubulars. The adjustable portions, such as slips, valves and the like may create localized diameter changes of the downhole tubular. That is, portions of the downhole tubular may include components or tubulars having increased wall thickness associated with the adjustable portions that create localized diameter changes of the downhole tubular system. Reducing an overall number of diameter changes in a system of tubulars can lead to an overall cost savings in well bore construction and operation.

SUMMARY

Disclosed is a downhole tool including a mandrel, at least one moveable component mounted to the mandrel, and a locking ring mounted to the mandrel. The locking ring includes a plurality of locking ring segments that enable relative movement between the mandrel and the at least one moveable component. A plurality of circumferential spaces is arranged between corresponding ones of the locking ring segments. At least one load bar is arranged in at least one of the plurality of circumferential spaces. The at least one load bar is mechanically connected to the at least one moveable component.

BRIEF DESCRIPTION OF THE DRAWINGS

Referring now to the drawings wherein like elements are numbered alike in the several Figures.

DETAILED DESCRIPTION

Figure 1:
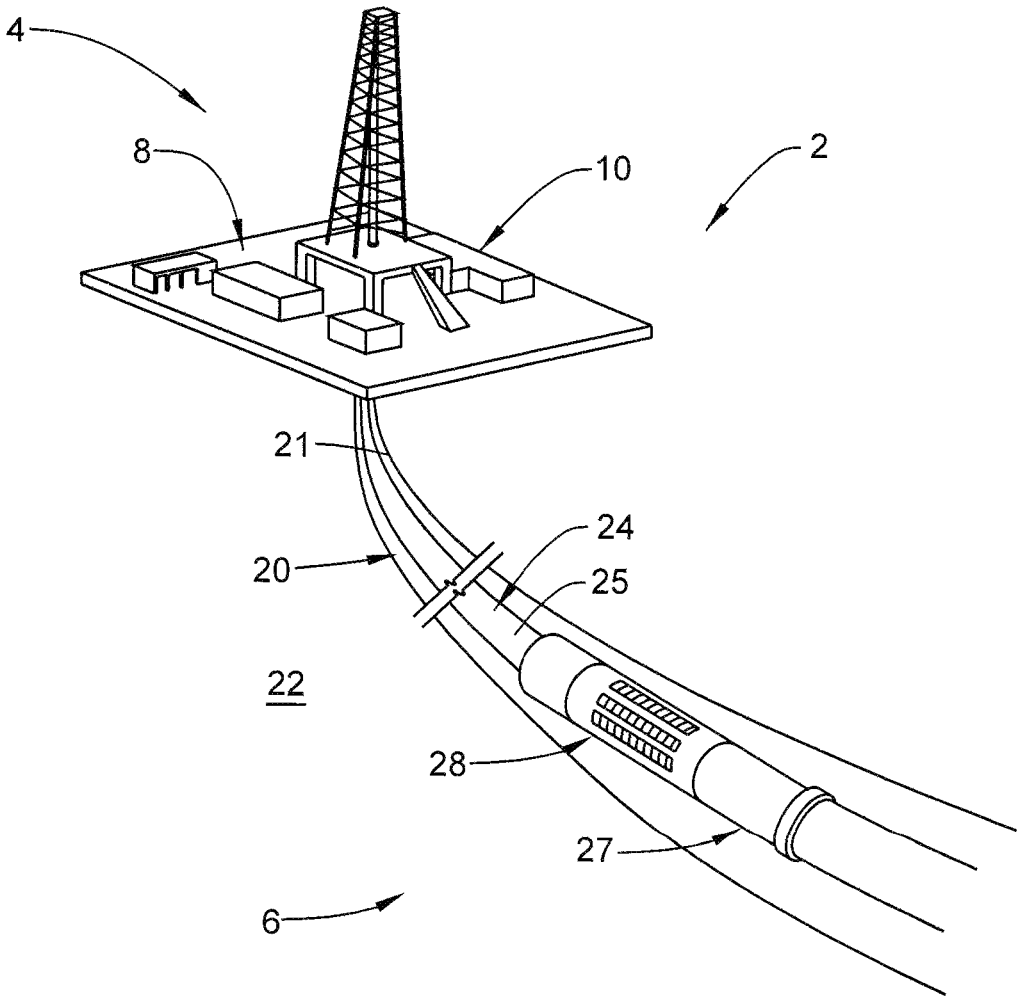
FIG. 1 depicts a resource exploration system including a seal assembly, in accordance with an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include a surface system 4 operatively connected to a downhole system 6. Surface system 4 may include pumps 8 that aid in completion and/or extraction processes as well as fluid storage 10. Fluid storage 10 may contain a gravel pack fluid or slurry (not shown) that is introduced into downhole system 6.

Downhole system 6 may include a system of tubulars 20 that are extended into a wellbore 21 formed in formation 22. System of tubulars 20 may be formed from a number of connected downhole tools or tubulars 24 and include a liner top extension 25 that extend downhole to a seal assembly 27 through a non-expandable hanger or mandrel 28. Seal assembly 27 is selectively deployed downhole of mandrel 28 in order to isolate one portion of wellbore 21 from another portion of wellbore 21. It is to be understood that the term "non-expandable mandrel" is meant to describe a mandrel that does not deform radially to engage walls of wellbore 21 or a well casing if present.

Figure 2:
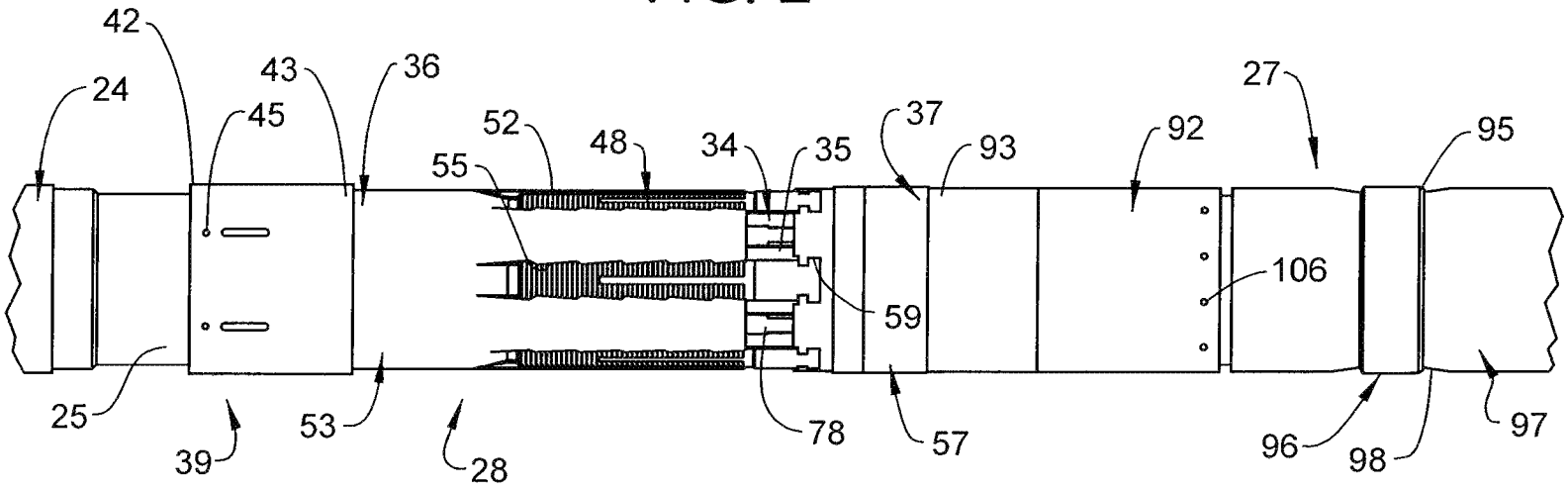
FIG. 2 depicts a plan view of the seal assembly, in accordance with an aspect of an exemplary embodiment.
Figure 3:
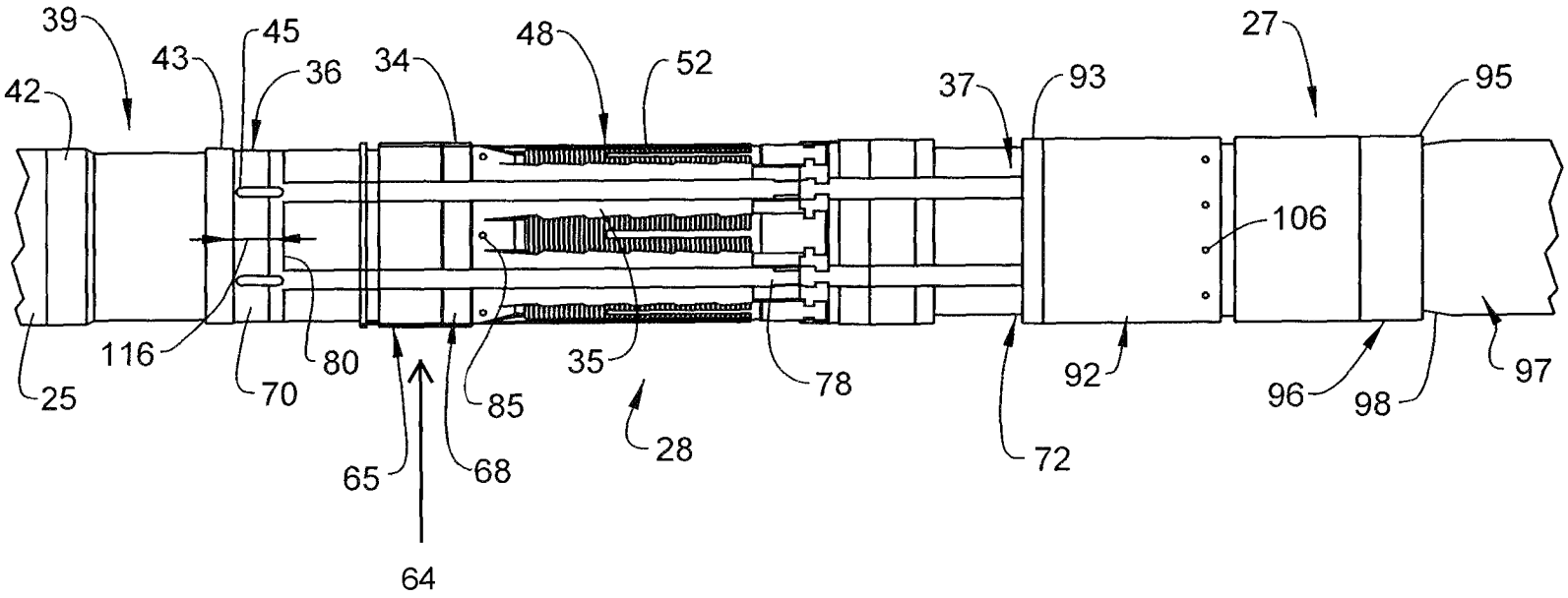
FIG. 3 depicts the seal assembly of FIG. 2 without a slip seat.

In accordance with an aspect of an exemplary embodiment illustrated in FIGS. 2-3, non-expandable mandrel 28 includes a body 34 having an outer surface 35, an inner surface (not separately labeled), an uphole end 36, and a downhole end 37 mechanically coupled to seal assembly 27. A moveable component or decoupling sleeve 39 is mechanically coupled to uphole end 36 of mandrel 28. Decoupling sleeve 39 includes an uphole end portion 42 that receives liner top extension 25 and a downhole end portion 43. Decoupling sleeve 39 supports a first plurality of shear members 45 that are designed to shear upon being exposed to a first force. It is to be understood that the particular type of shear members employed may vary.

Non-expandable mandrel 28 supports a plurality of slip members, one of which is indicated at 48. Slip members 48 include surface features 52 and may be radially outwardly extended to affix non-expandable mandrel 28 at a desired position relative to wellbore 21. Non-expandable mandrel 28 is also shown to include a slip seat 53 (FIG. 2) that partially covers body 34. Slip seat 53 includes a plurality of windows, one of which is indicated at 55, which provide an opening through which each slip member 48 may extend. A cover ring 57 (FIG. 2) may be provided to partially cover another portion of body 34 adjacent downhole end 37. Cover ring 57 includes window portions 59 that are positioned to accommodate radial outward movement of slip members 48. Once deployed, surface features 52 on slip members 48 bite into wall portions (not separately labeled) of wellbore 21 to affix non-expandable mandrel 28.

Non-expandable mandrel 28 also includes a lock assembly 64 defined by a lock ring 65 (FIG. 3) having a plurality of ridges 67 (FIG. 6) arranged near uphole end 36, a locking member 68 downhole from lock ring 65, a first load ring 70 arranged near uphole end 36 and a second load ring 72 arranged at downhole end 37. A plurality of load bars, one of which is indicated at 78 extends between first load ring 70 and second load ring 72. Load bar 78 includes a plurality of ridges, one of which is indicated at 79, that may be selectively aligned with ridges 67 on lock ring 65. A load bar link 80 is arranged at first load ring 70 and mechanically links each of the plurality of load bars 78. As will be detailed below, load bars 78 transfer an axial load from decoupling sleeve 39 to seal assembly 27. Body 34 of non-expandable mandrel 28 includes a second plurality of shear members 85 that are designed to shear upon being exposed to a second force, which is less than the first force. Shear members 85 prevent axial loading of the plurality of load bars 78 prior to setting slip members 48.

Seal assembly 27 includes another moveable component that may take the form of a seal body 92 including an uphole end section 93 coupled to downhole end 37 of non-expandable mandrel 28 and a downhole end section 95 that supports a seal member 96. Downhole end section 95 extends to a mandrel 97 having a tapered end 98. As will be detailed below, seal assembly 27 is shifted toward mandrel 97 causing a radial outward expansion of seal member 96. Seal member 96 engages with side walls (not separately labeled) of wellbore 21. Seal member 96 fluidically isolates one portion (downhole) of wellbore 21 from another portion (uphole) of wellbore 21. Seal assembly 27 includes a third plurality of shear members 106 that are designed to shear upon being exposed to a third force, which may be substantially equal to the second force. Tapered end 98 of mandrel 97 is positioned at downhole end 37. The particular design of mandrel 97 including tapered end 98 ensures that a wall thickness (not shown) of mandrel 97 below the seal element 94 is equivalent or greater than a cross-sectional dimension of an associated liner. Therefore, pressure containment ratings of this system preserve liner pressure ratings.

Figure 4:
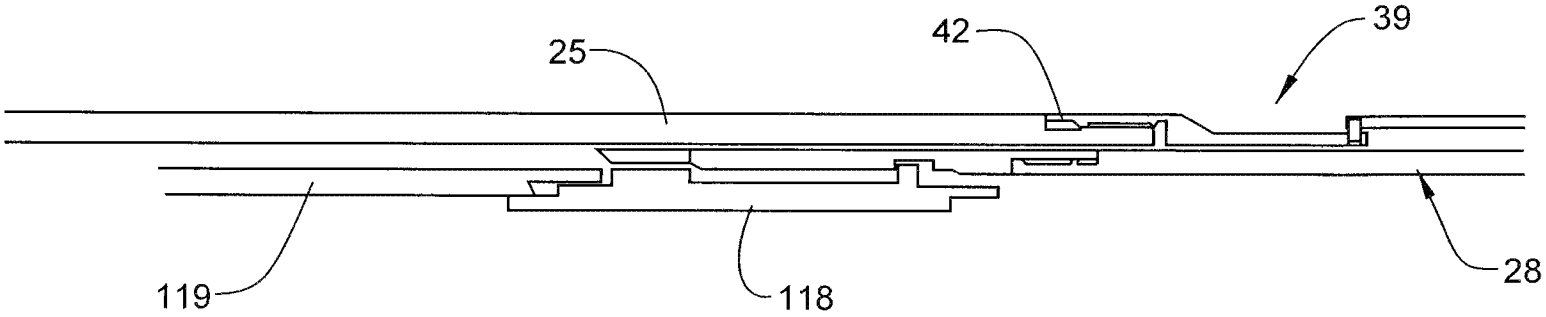
FIG. 4 depicts a partial cross-sectional view of an uphole end of the seal assembly, in accordance with an aspect of an exemplary embodiment.

Prior to setting, a gap 116 exists between decoupling sleeve 39 and first load ring 70 as shown in FIG. 3. Gap 116 is sized to be greater than an expected travel of decoupling sleeve 39 when setting slip members 48. A tool 118, as shown in FIG. 4 is run into a system of tubulars 20 as part of a drill string 119 that extends from surface system 4 to set slip members 48. Tool 118, which may take the form of a pusher tool, applies an axial force to the liner top extension which moves axially into non-expandable mandrel 28 causing the second plurality of shear members 85 to shear.

Figure 5:
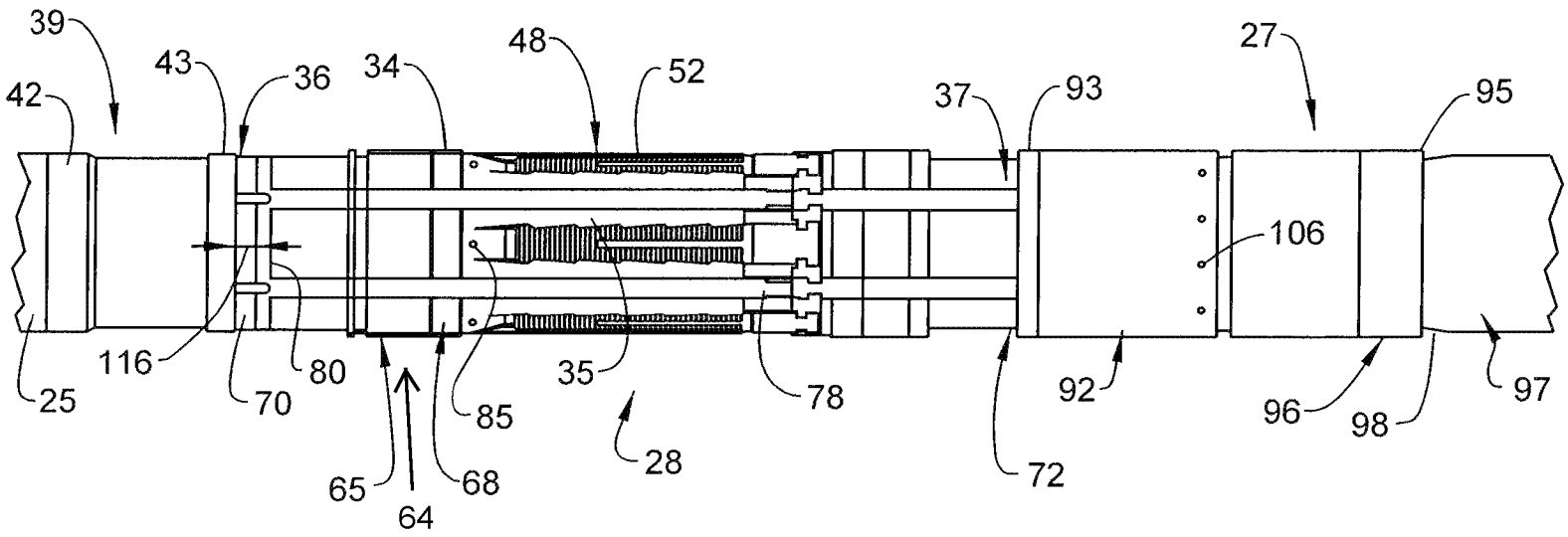
FIG. 5. depicts the seal assembly of FIG. 3 after setting a plurality of slip members.

For example, the tool may include a ball seat (not shown). An activation ball (also not shown) may be introduced into wellbore 21 and guided to the ball seat. Fluid may be introduced into wellbore 21 to a selected pressure. The applied force passes through decoupling sleeve 39 into non-expandable mandrel 28 causing the second plurality of shear members 85 to shear allowing slip seat 53 to deploy slip members 48 as shown in FIG. 5. At this point, the activation ball may be extruded. Tool 118 includes a designed amount of axial stroke. The axial stroke achieved while setting slip member 48 after the second shear member 85 shears, is not sufficient to load any other shear members of seal assembly 27, e.g. shear members 45 and 106.

Figure 6:
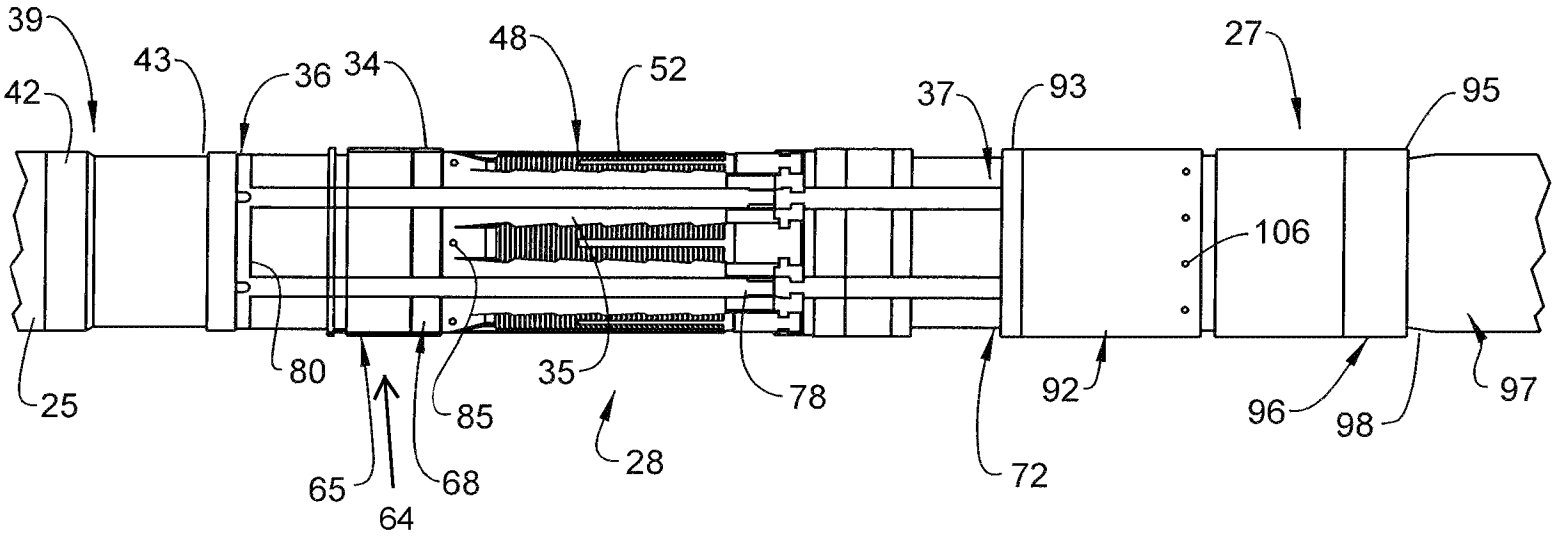
FIG. 6 depicts the seal assembly of FIG. 5 following axial shifting of a decoupling sleeve arranged at the uphole end.

At this point the tool may be released and a downhole operation, such as cementing may take place. After cementing, set down weight of system of tubulars 20 causes first plurality of shear members 45 to shear allowing decoupling sleeve 39 to shift further closing gap 116 as shown in FIG. 6. The set down weight passes into first load ring 70, through load bars 78 to second load ring 72 and into seal body 92 causing the third plurality of shear members 106 to shear allowing seal member 96 to travel onto tapered end 98 and expand radially outwardly creating an annular seal against an internal surface of wellbore 21.

Figure 7:
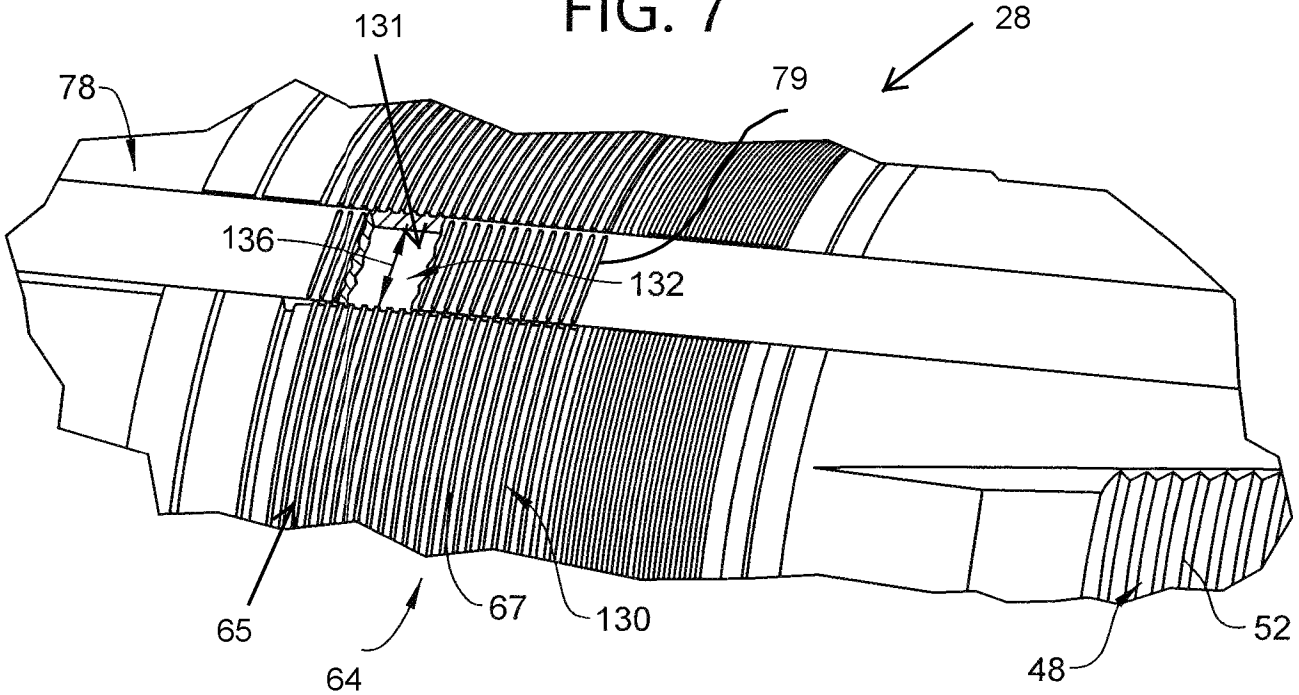
FIG. 7 depicts a partial cut-away view of a load bar passing between lock ring segments, in accordance with an aspect of an exemplary embodiment.

In accordance with an aspect of an exemplary embodiment illustrated in FIG. 7, load bars 78 extend along non-expandable mandrel with little, if any, increase in outer diameter. More specifically, load bars 78 pass between one or more locking ring segments 130 that collectively form lock ring 65. Adjacent locking ring segments 130 are separated by a plurality of circumferential spaces 131 each of which defines a channel 132 that forms a gap 136 sized to receive one of load bars 78.

Figure 8:
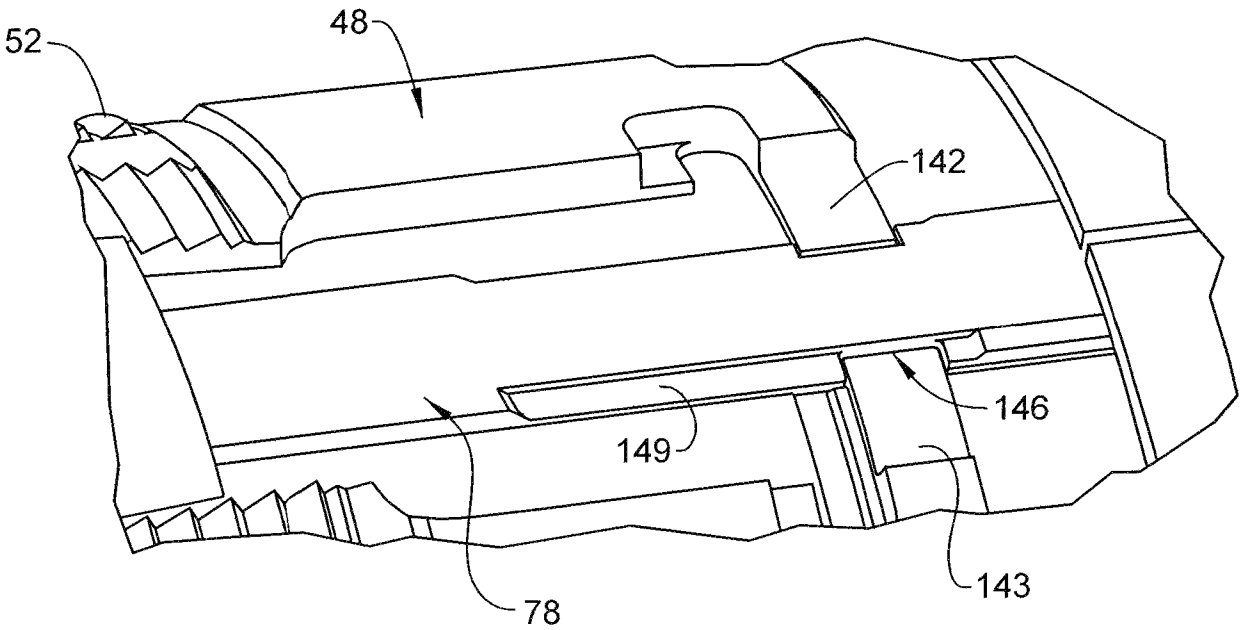
FIG. 8 depicts slip members engaged with a downhole end of a load bar, in accordance with an aspect of an exemplary embodiment.
Figure 9:
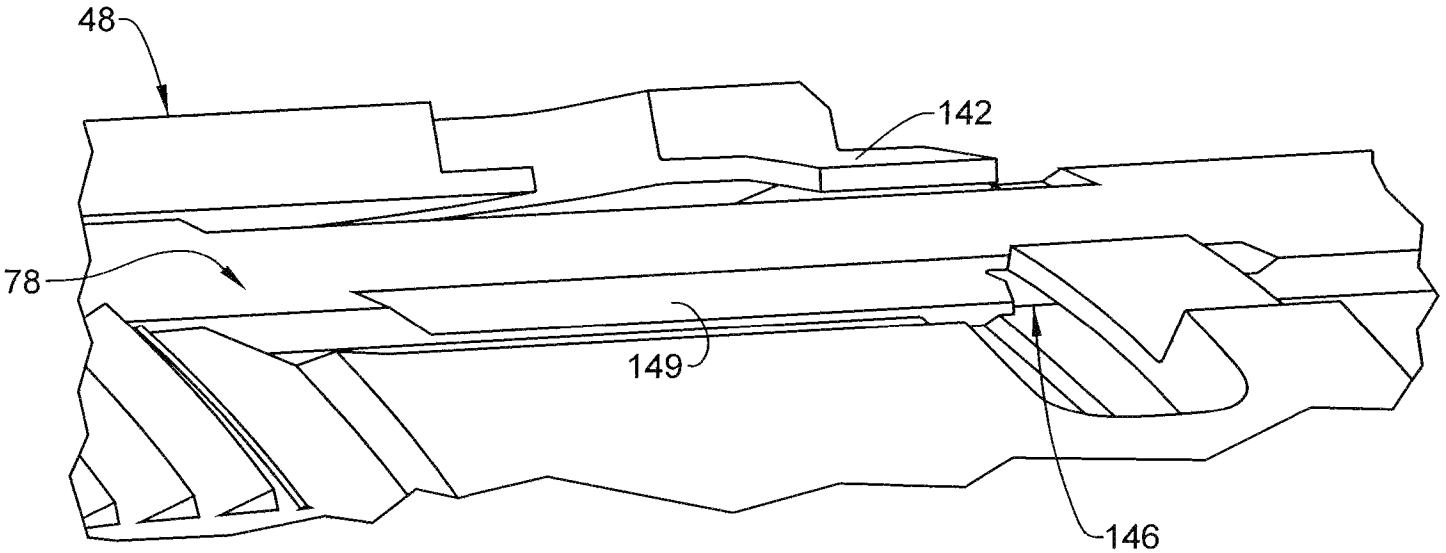
FIG. 9 depicts the slip member of FIG. 8 disengaging from the load bar during setting, in accordance with an aspect of an exemplary embodiment.

In accordance with another aspect of an exemplary embodiment illustrated in FIGS. 8 and 9, each slip member 48 includes a pair of tab members such as seen at 142 and at 143 on an adjacent slip member 48. Prior to deployment of slip members 48, tab members 142 and 143 nest within tab receiving recesses 146 formed in each load bar 78. Each load bar 78 also includes a reduced thickness portion 149 to accommodate shorter deployment of slip members 48. In this manner, slip members 48 will lock load bars 78 into place during deployment of system of tubulars 20 and setting of non-expandable mandrel 28. Once slip member 48 are set, load bars 78 may move freely to transmit an axial force from decoupling sleeve 39 to seal assembly 27 to set seal member 96.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

Embodiment 1

A downhole tool including a mandrel, at least one moveable component mounted to the mandrel, a locking ring mounted to the mandrel, the locking ring including a plurality of locking ring segments that enable relative movement between the mandrel and the at least one moveable component, a plurality of circumferential spaces arranged between corresponding ones of the locking ring segments, and at least one load bar arranged in at least one of the plurality of circumferential spaces, the at least one load bar being mechanically connected to the at least one moveable component.

Embodiment 2

The downhole tool according to any prior embodiment, wherein the lock bar does not project radially proudly of the locking ring.

Embodiment 3

The downhole tool according to any prior embodiment, wherein the at least one moveable component comprises a first moveable component and a second moveable component, the load bar being operatively connected between the first and second moveable components.

Embodiment 4

The downhole tool according to any prior embodiment, wherein the at least one load bar comprises a plurality of load bars arranged in corresponding ones of the plurality of circumferential spaces, each of the plurality of load bars being operatively connected to the first and second moveable components.

Embodiment 5

The downhole tool according to any prior embodiment, wherein the first moveable component is axially spaced from the second moveable component along the mandrel.

Embodiment 6

The downhole tool according to any prior embodiment, further comprising: a load bar link mechanically connecting each of the plurality of load bars.

Embodiment 7

The downhole tool according to any prior embodiment, wherein the first moveable component is a decoupling sleeve and the second moveable component comprises a seal body.

Embodiment 8

The downhole tool according to any prior embodiment, further including one or more slip members selectively radially outwardly moveable relative to the mandrel.

Embodiment 9

The downhole tool according to any prior embodiment, wherein the at least one moveable component is operatively connected to the one or more slip members.

Embodiment 10

The downhole tool according to any prior embodiment, wherein each of the plurality of locking ring segments includes a first plurality of ridges and the at least one load includes a second plurality of ridges that may be selectively aligned with the first plurality of ridges.

Embodiment 11

The downhole tool according to any prior embodiment, wherein the at least one load bar is axially shiftable relative to the plurality of locking ring segments.

The terms "about" and "substantially" are intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole tool comprising:

a mandrel;

at least one moveable component mounted to the mandrel;

a locking ring mounted to the mandrel, the locking ring including a plurality of circumferentially spaced locking ring segments that enable relative movement between the mandrel and the at least one moveable component;

a plurality of circumferential spaces arranged between corresponding ones of the plurality of circumferentially spaced locking ring segments; and at least one load bar slidingly received in at least one of the plurality of circumferential spaces, the at least one load bar being mechanically connected to the at least one moveable component.

2. The downhole tool according to claim 1, wherein the lock bar does not project radially proudly of the locking ring.

3. The downhole tool according to claim 1, wherein the at least one moveable component comprises a first moveable component and a second moveable component, the load bar being operatively connected between the first and second moveable components.

4. The downhole tool according to claim 3, wherein the at least one load bar comprises a plurality of load bars arranged in corresponding ones of the plurality of circumferential spaces, each of the plurality of load bars being operatively connected to the first and second moveable components.

5. The downhole tool according to claim 3, wherein the first moveable component is axially spaced from the second moveable component along the mandrel.

6. The downhole tool according to claim 3, further comprising: a load bar link mechanically connecting each of the plurality of load bars.

7. The downhole tool according to claim 3, wherein the first moveable component is a decoupling sleeve and the second moveable component comprises a seal body.

8. The downhole tool according to claim 1, further comprising: one or more slip members selectively radially outwardly moveable relative to the mandrel.

9. The downhole tool according to claim 8, wherein the at least one moveable component is operatively connected to the one or more slip members.

10. The downhole tool according to claim 1, wherein each of the plurality of circumferentially spaced locking ring segments includes a first plurality of ridges and the at least one load bar includes a second plurality of ridges that is selectively aligned with the first plurality of ridges.

11. The downhole tool according to claim 1, wherein the at least one load bar is axially shiftable relative to the plurality of locking ring segments.

* * * * *